US007900924B2

(12) United States Patent
Ho

(10) Patent No.: US 7,900,924 B2
(45) Date of Patent: Mar. 8, 2011

(54) SHUFFLING MACHINE WITH A DETACHING ASSEMBLY FOR CARD INPUT AND OUTPUT

(75) Inventor: Cai-Shiang Ho, Taipei (TW)

(73) Assignee: Taiwan Fulgent Enterprise Co., Ltd. (TW)

( * ) Notice: Subject to any disclaimer, the term of this patent is extended or adjusted under 35 U.S.C. 154(b) by 202 days.

(21) Appl. No.: 12/386,794

(22) Filed: Apr. 23, 2009

(65) Prior Publication Data

US 2009/0302537 A1 Dec. 10, 2009

(51) Int. Cl.
*A63F 1/12* (2006.01)

(52) U.S. Cl. ..... 273/149 R; 463/22

(58) Field of Classification Search ..... 273/149 R, 273/149 P; 463/22
See application file for complete search history.

(56) References Cited

U.S. PATENT DOCUMENTS

| | | | | |
|---|---|---|---|---|
| 4,659,082 | A * | 4/1987 | Greenberg | 273/149 R |
| 6,254,096 | B1 * | 7/2001 | Grauzer et al. | 273/149 R |
| 6,659,460 | B2 * | 12/2003 | Blaha et al. | 273/149 R |
| 7,584,963 | B2 * | 9/2009 | Krenn et al. | 273/149 R |
| 2004/0245720 | A1 * | 12/2004 | Grauzer et al. | 273/149 R |

* cited by examiner

*Primary Examiner* — Benjamin H Layno
(74) *Attorney, Agent, or Firm* — Jackson Walker, LLP

(57) ABSTRACT

A shuffling machine has a shuffler, a card input, a card output, an input detaching assembly and an output detaching assembly. The input detaching assembly is mounted between the shuffler and the card input to connect the card input detachably to the shuffler. The output detaching assembly is mounted between the shuffler and the card output to connect the card output detachably to the shuffler. Therefore, the shuffler, the card input and the card output may be manufactured and sold separately to simplify manufacturing processes and reduce buying cost.

11 Claims, 5 Drawing Sheets

SHUFFLING MACHINE WITH A DETACHING ASSEMBLY FOR CARD INPUT AND OUTPUT

RELATED PATENT APPLICATION

This application in part disclosed and claims priority from subject matter disclosed in the earlier filed patent application Ser. No. 12/156,802, filed on Jun. 5, 2008 now abandoned.

BACKGROUND OF THE INVENTION

1. Field of the Invention

The present invention relates to a shuffling machine with a detaching assembly for card input and output, especially to a shuffling machine used in casinos to shuffle cards and output cards randomly.

2. Description of the Prior Arts

In casinos, card games are popular and have various game rules. Every card game needs a dealer to shuffle and deal the cards to the players. To avoid cheating, shuffling machines have been developed.

A conventional shuffling machine has a shuffler, a card input and a card output. The cards are received by the card input and are delivered into the shuffler. The shuffler has a controller to drive the shuffler to rotate in a random direction so that the cards are mixed. Then the cards are output from the card output.

According to different rules of the card games, the card input and output are different. For example, Baccarat and Blackjack usually have at least four decks of cards so that the card input for Baccarat and Blackjack must be able to receive multiple cards and to deliver the card one by one to the shuffler quickly. Further, Texas holdem poker usually requires multiple cards be dealt to multiple players in a short time so the card output must be able to deal cards quickly. Therefore, the shuffling machine for different card games may be different to accommodate various card games.

However, for the manufacturer to produce different shuffling machines various processes, machine tools and molds must be developed so the plant operation costs are higher. Furthermore, since each casino only has a limited number tables for all card games, casino managers require flexibility to adjust proportions of different card games on the table in the casino based on the season, trend and the like. Therefore, if different shuffling machines for different card games are required, extra shuffling machines must be purchased and stored when not in use, raising start up and maintenance costs for casinos.

To overcome the shortcomings, the present invention provides a shuffling machine with a detaching assembly for card input and output to mitigate or obviate the aforementioned problems.

SUMMARY OF THE INVENTION

The main objective of the present invention is to provide a shuffling machine with a detaching assembly for card input and output. The shuffling machine has a shuffler, a card input, a card output, an input detaching assembly and an output detaching assembly. The input detaching assembly is mounted between the shuffler and the card input to connect the card input detachably to the shuffler. The output detaching assembly is mounted between the shuffler and the card output to connect the card output detachably to the shuffler. Therefore, the shuffler, the card input and the card output may be manufactured as modules for separate sale to simplify manufacturing processes, further to adapt use of the shuffler, alternative card input and outputs may be attached for different card games and to reduce purchasing and maintenance costs and storage requirements.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
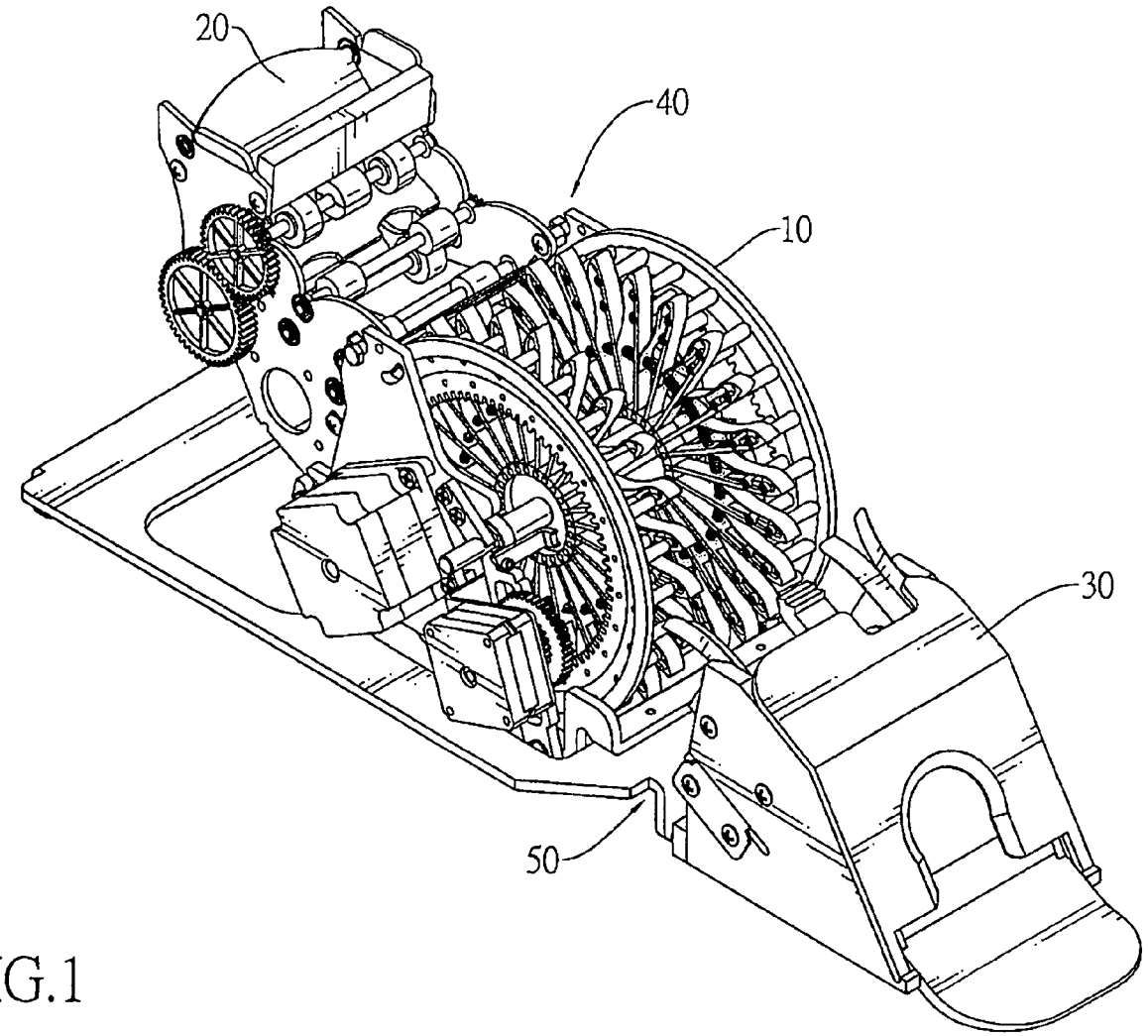
FIG. 1 is a perspective view of a first embodiment of a shuffling machine with a detaching assembly for card input and output in accordance with the present invention.
Figure 2:
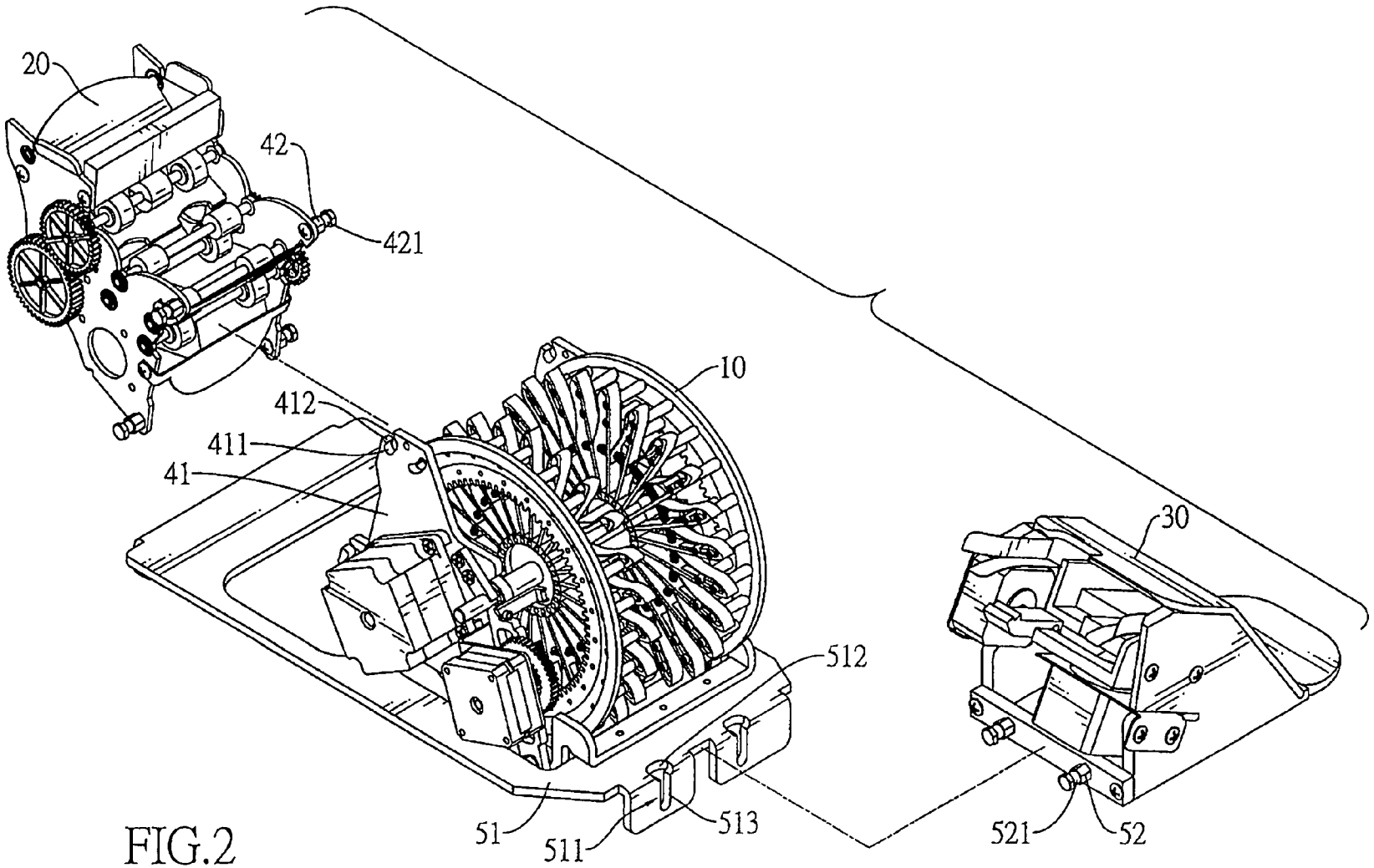
FIG. 2 is an exploded perspective view of the shuffling machine in FIG. 1.

With reference to FIGS. 1 and 2, a shuffling machine with a detaching assembly for card input and output in accordance with the present invention comprises a shuffler (10), a card input (20), a card output (30), an input detaching assembly (40) and an output detaching assembly (50).

Figure 4:
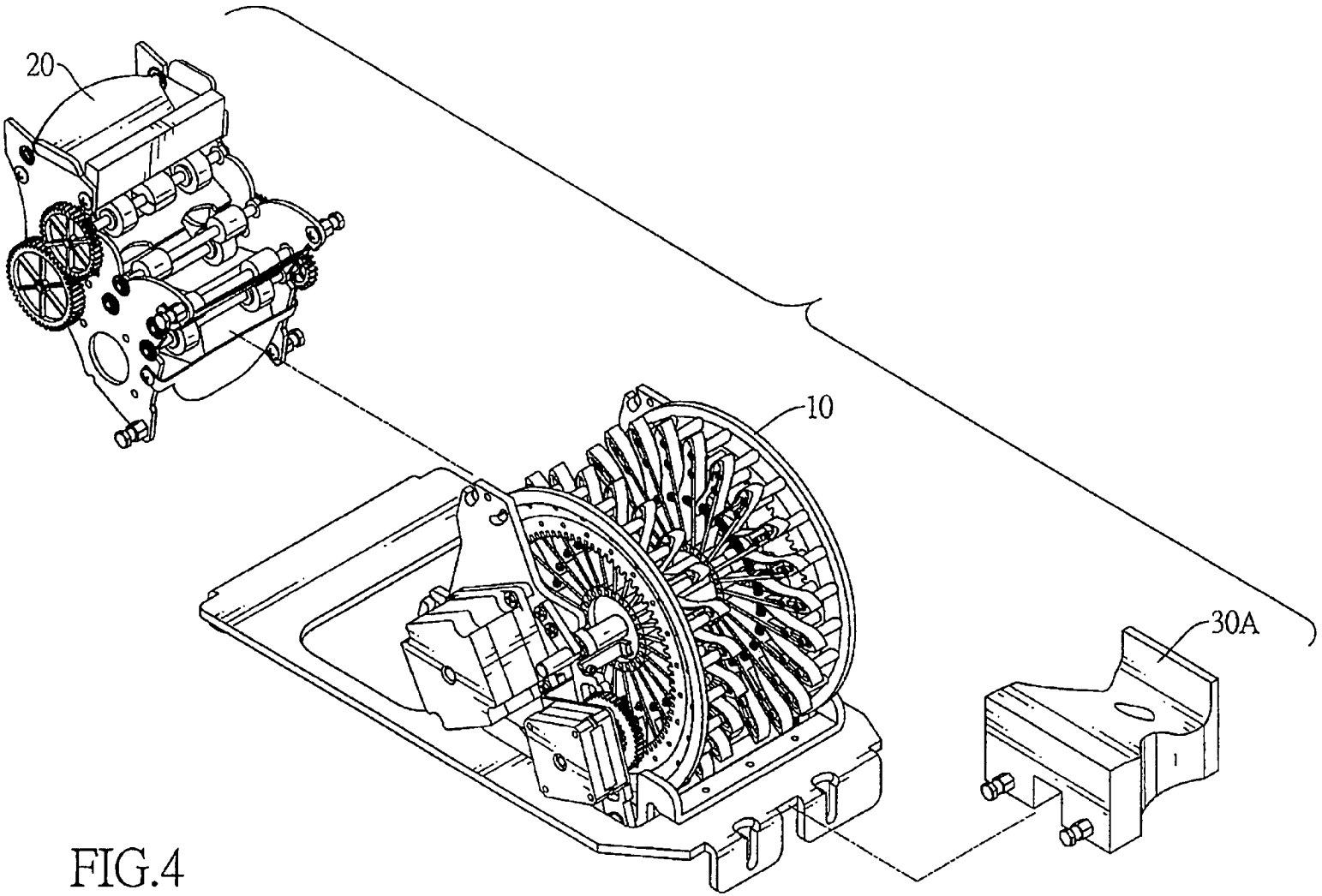
FIG. 4 is an exploded perspective view of a second embodiment of a shuffling machine with a detaching assembly for card input and output in accordance with the present invention.
Figure 5:
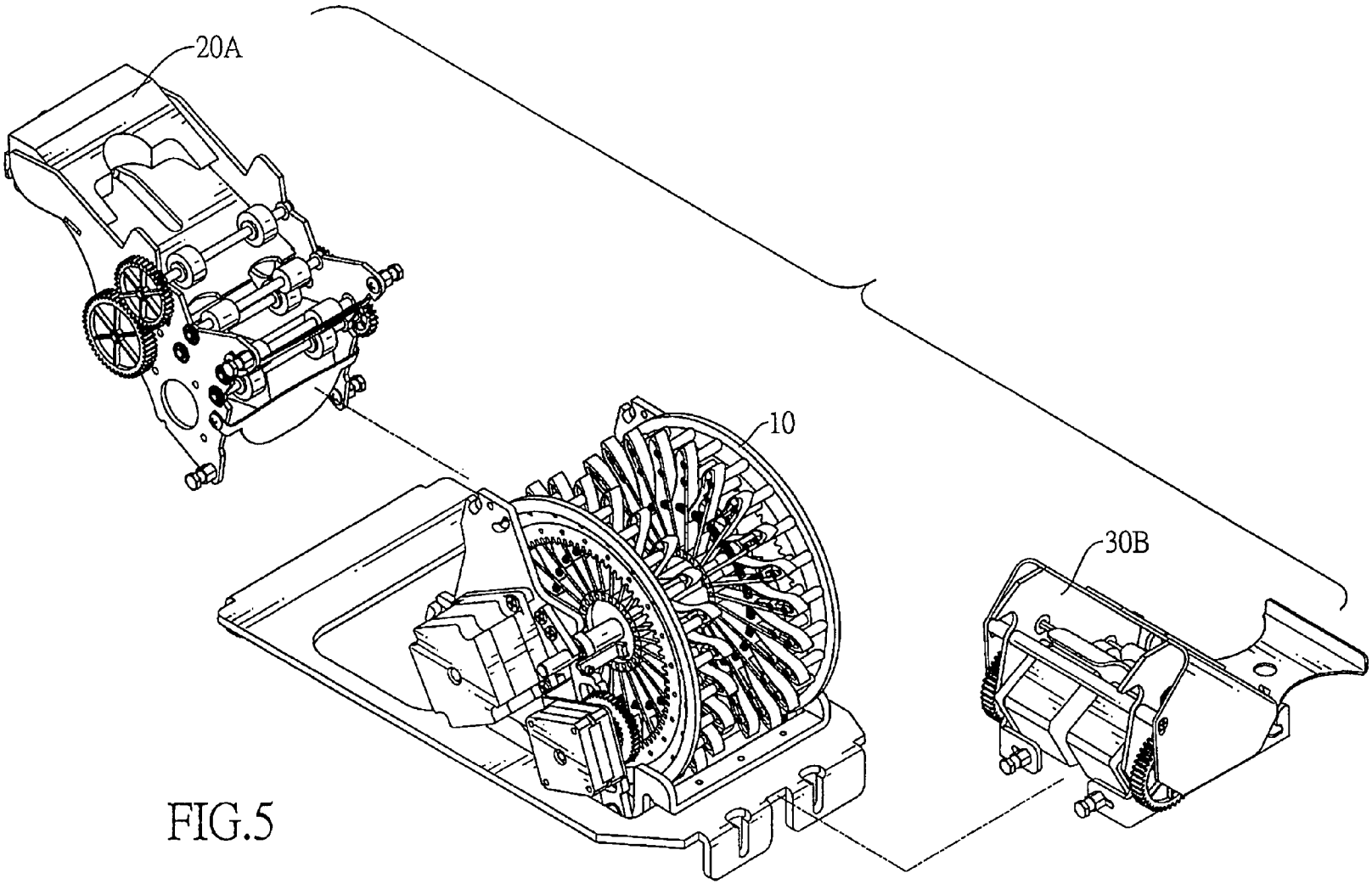
FIG. 5 is an exploded perspective view of a third embodiment of a shuffling machine with a detaching assembly for card input and output in accordance with the present invention.

The shuffler (10) has an input end and an output end. The card input (20) is connected detachably to the input end of the shuffler (10). The card output (30) is connected detachably to the output end of the shuffler (10). Detailed structures of the shuffler (10), the card input (20) and the card output (30) are already disclosed in earlier filed patent application Ser. No. 12/156,802 or are well known in the art so are not discussed in the referenced application. With further reference to FIGS. 4 and 5, the card input (20, 20A) and the card output (30, 30A, 30B) may be different to accommodate various card games.

Figure 3:
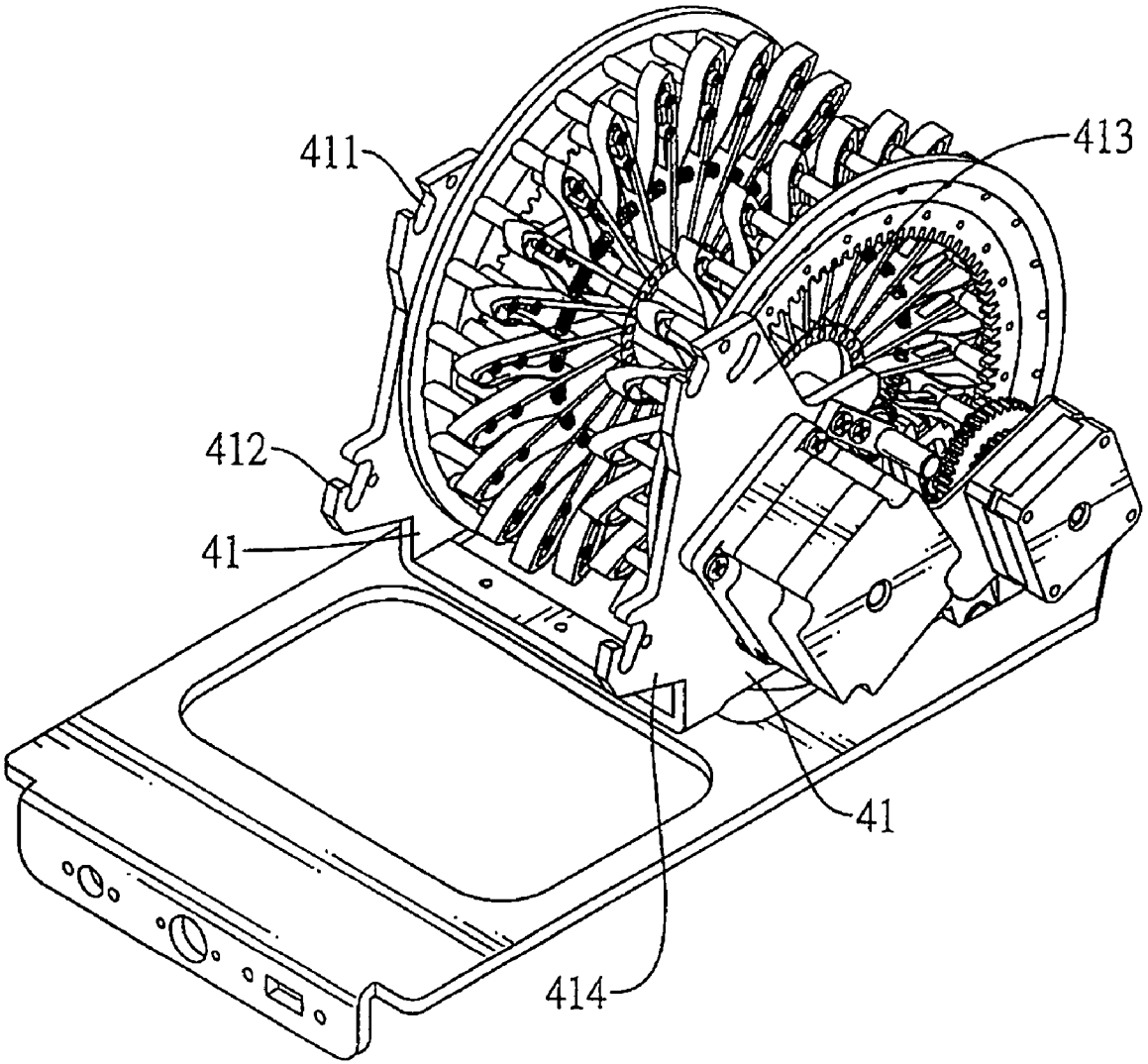
FIG. 3 is a partial perspective view of the shuffling machine in FIG. 1.

With reference to FIGS. 1 to 3, the input detaching assembly (40) is mounted between input end of the shuffler (10) and the card input (20) to detachably connect the card input (20) to the shuffler (10) and has a holding bracket (41) and at least one holder (42). The holding bracket (41) has a distal edge and at least one locking recess (411). The locking recess (411) is formed in the distal edge, and each locking recess (411) has an opening and a limit (412). The limit (412) is formed on the distal edge of the holding bracket (41) and is adjacent to the opening of the locking recess (411). Each holder (42) is selectively held in a corresponding locking recess (411) of the holding bracket (41), may be selectively held by the limit (412) of the corresponding locking recess (411) and has an outer wall and an annular groove (421). The annular groove (421) is formed around the outer wall of the holder (42) and selectively abuts the limit (412) of the corresponding locking recess (411).

In a preferred embodiment, the holding bracket (41) is U-shaped and has two wings and four locking recesses (411), and the input detaching assembly (40) has four holders (42). The wings of the holding bracket (41) are mounted respectively on two sides of the shuffler (10). Each wing has an upper ear (413) and a lower ear (414). Each locking recess (411) is formed in a distal edge of a corresponding ear (413, 414). Each limit (412) is formed on the distal edge of the corresponding ear (413, 414). The card input (20) has a connecting end. The connecting end of the card input (20) has four corners. The holders (42) are formed respectively on and protrude out the corners of the connecting end of the card input (20).

With reference to FIGS. 1 and 2, the output detaching assembly (50) is mounted between the output end of the shuffler (10) and the card output (30) to connect the card output (30) detachably to the shuffler (10) and has a holding frame (51) and at least one holder (52). The holding frame (51) has a distal edge and at least one locking hole (511). Each locking hole (511) is formed in the distal edge of the holding frame (51), may be L-shaped and has a lateral hole (512) and an upright hole (513). The lateral hole (512) is wider than the upright hole (513). Each holder (52) is selectively held in a corresponding locking hole (511) of the holding frame (51), may be selectively held in the upright hole (513) of the corresponding locking hole (511) and has an outer wall and an annular groove (521). The annular groove (521) is formed around the outer wall of the holder (52) and selectively engages the upright hole (513) of the corresponding locking hole (511).

In a preferred embodiment, the holding frame (51) has two locking holes (511), and the output detaching assembly (50) has two holders (52). The holding frame (51) is attached securely to a bottom of the shuffler (10). The holders (52) are formed on and protrude out a connecting end of the card output (30) near a bottom of the card output (30).

With the input and output detaching assemblies (40, 50), the card input and output (20, 30) are easily and efficiently detached from and connected to the shuffler (10). For a manufacturer, the shuffler (10), the card input (20) and the card output (30) are produced separately to simplify manufacture processes and to easily sell separately or in combination as desired. Furthermore, since the shuffler (10), the card input (20) and the card output (30) may be sold separately and are easily connected to each other, user may buy fewer shufflers (10) and more card inputs and outputs (20, 30) to combine as different shuffling machines for different card games. Therefore, purchasing costs are reduced for the users.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A shuffling machine comprising:

a shuffler having an input end and an output end;

a card input being connected detachably to the input end of the shuffler;

a card output being connected detachably to the output end of the shuffler;

an input detaching assembly being mounted between input end of the shuffler and the card input to connect the card input detachably to the shuffler and having a holding bracket having a distal edge; and at least one locking recess being formed in the distal edge of the holding bracket; and at least one holder, each one of the at least one holder being selectively held in a corresponding locking recess of the holding bracket; and an output detaching assembly being mounted between the output end of the shuffler and the card output to detachably connect the card output to the shuffler and having a holding frame having a distal edge; and at least one locking hole being formed in the distal edge of the holding frame; and at least one holder, each one of the at least one holder being selectively held in a corresponding locking hole of the holding frame.

2. The shuffling machine as claimed in claim 1, wherein each one of the at least one locking recess of the holding bracket has an opening; and a limit being formed on the distal edge of the holding bracket and being adjacent to the opening of the locking recess; and each one of the at least one holder of the input detaching assembly being selectively held by the limit of the corresponding locking recess.

3. The shuffling machine as claimed in claim 2, wherein each one of the at least one holder of the input detaching assembly has an outer wall; and an annular groove being formed around the outer wall of the holder, selectively engaging the corresponding locking recess of the holding bracket and selectively abutting the limit of the corresponding locking recess of the holding bracket.

4. The shuffling machine as claimed in claim 3, wherein each one of the at least one locking hole of the holding frame has a lateral hole and an upright hole, and the lateral hole is wider than the upright hole.

5. The shuffling machine as claimed in claim 4, wherein each one of the at least one holder of the output detaching assembly has an outer wall; and an annular groove being formed around the outer wall of the holder of the output detaching assembly and selectively engaging the upright hole of the corresponding locking hole of the holding frame.

6. The shuffling machine as claimed in claim 5, wherein the holding bracket is U-shaped and has two wings being mounted respectively on two sides of the shuffler, and each wing has an upper ear and a lower ear; and four locking recesses, each locking recess being formed in a distal edge of a corresponding ear, and each limit being formed on the distal edge of the corresponding ear;

the input detaching assembly has four holders being formed respectively on and protruding out from four corners of a connecting end of the card input.

7. The shuffling machine as claimed in claim 6, wherein the holding frame of the output detaching assembly has two locking holes and is attached securely to a bottom of the shuffler; and the output detaching assembly has two holders being formed on and protruding out from a connecting end of the card output near a bottom of the card output.

8. The shuffling machine as claimed in claim 1, wherein each one of the at least one locking hole of the holding frame has a lateral hole and an upright hole, and the lateral hole is wider than the upright hole.

9. The shuffling machine as claimed in claim 8, wherein each one of the at least one holder of the output detaching assembly has an outer wall; and an annular groove being formed around the outer wall of the holder of the output detaching assembly and selectively engaging the upright hole of the corresponding locking hole of the holding frame.

10. The shuffling machine as claimed in claim 1, wherein the holding bracket is U-shaped and has two wings being mounted respectively on two sides of the shuffler, and each wing has an upper ear and a lower ear; and four locking recesses, each locking recess being formed in a distal edge of a corresponding ear, and each limit being formed on the distal edge of the corresponding ear;

the input detaching assembly has four holders being formed respectively on and protruding out from four corners of a connecting end of the card input.

11. The shuffling machine as claimed in claim 1, wherein the holding frame of the output detaching assembly has two locking holes and is attached securely to a bottom of the shuffler; and the output detaching assembly has two holders being formed on and protruding out from a connecting end of the card output near a bottom of the card output.

* * * * *